US006549892B1

(12) United States Patent
Sansone

(10) Patent No.: US 6,549,892 B1
(45) Date of Patent: Apr. 15, 2003

(54) SYSTEM FOR DELIVERING MAIL

(75) Inventor: Ronald P. Sansone, Weston, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/316,403

(22) Filed: May 21, 1999

(51) Int. Cl.[7] ..... G07B 17/00
(52) U.S. Cl. ..... 705/401
(58) Field of Search ..... 705/1, 26, 401, 705/408, 410, 27

(56) References Cited

U.S. PATENT DOCUMENTS

| | | | | |
|---|---|---|---|---|
| 4,831,555 A | | 5/1989 | Sansone et al. | 364/519 |
| 5,146,403 A | * | 9/1992 | Goodman | 707/102 |
| 5,420,403 A | | 5/1995 | Allum et al. | 235/375 |
| 5,422,821 A | | 6/1995 | Allen et al. | 364/478 |
| 5,805,810 A | * | 9/1998 | Maxell | 709/206 |
| 5,987,508 A | * | 11/1999 | Agraharam et al. | 709/217 |
| 6,006,200 A | * | 12/1999 | Boies et al. | 705/26 |
| 2001/0040955 A1 | * | 11/2001 | Zolner et al. | 379/218.01 |

FOREIGN PATENT DOCUMENTS

JP 09-57199 * 3/1997

OTHER PUBLICATIONS

"Littlewoods, United Kingdom Soccer Pools Organization, Orders More Than $9 Million Worth of Symbol Technologies' Computers"; Business Wire, Mar. 29, 1999, p. 1278.*

* cited by examiner

*Primary Examiner*—Edward R. Cosimano
(74) *Attorney, Agent, or Firm*—Ronald Reichman; Angelo N. Chaclas

(57) ABSTRACT

A method that enables the post to deliver letters, flats, post cards and packages (mail) addressed to a recipient name and unique code to be delivered directly to the recipient. Mail addressed to a name and a unique code would be captured by the post during the posts sortation process and rerouted to the delivery address of the unique code.

12 Claims, 10 Drawing Sheets

POST REQUESTING A DELIVERABLE POSTAL ADDRESS FOR A RSSN

SYSTEM FOR DELIVERING MAIL

CROSS REFERENCE TO RELATED APPLICATIONS

Reference is made to commonly assigned copending patent application Ser. No. 09/315,795 filed herewith entitled "Virtual Post Office Box" in the names of Ronald P. Sansone, Fran E. Blackman, Daniel Dlugos, Leon A. Pintsov, Denis Stemmle, and Francis X. Hines, Jr.

FIELD OF THE INVENTION

The invention relates generally to the field of mail delivery systems and more particularly to systems for delivering mail to the correct delivery address.

BACKGROUND OF THE INVENTION

From the dawn of civilization people have directly transmitted information from one person to another. Information was first transmitted by speech and later by the written word. Writings enabled people to transmit information by messengers from a location in which the sender of the writing was present to another location where the receiver was present. In time, postal services were developed in which a person would deliver a letter to the post office in one city and an agent of the post office would deliver that letter to a post office in another city, where the letter would be picked up by the person to whom the letter was sent.

Ever since the numeric codification of streets and buildings received general acceptance, an individuals' name and their household postal addresses have been linked. The sender of a letter or package would deliver a letter or package to the post, that had the correct recipient postal address and the post would deliver the letter or package to the numeric street address of the recipient of the letter or package. A correct recipient postal address for the delivery of the letter or package to the recipient included: the name of the recipient; the street address of the recipient; the city and state of the recipient; and the zip code of the recipient. Thus, the correct recipient postal address is usually the actual location of the recipient.

Letters or packages addressed to a correct recipient postal address are sometimes not delivered because the recipient may have moved and not yet completed a change-of-address form with the United States Postal Service (USPS). In that case, what likely would have happened is that the new resident of the address would have marked the mail "Not at this Address" and put it back in a mail box. However, since the Postal Service would have no better address, it would have marked the mail piece "Undeliverable as Addressed," endorsed the piece with "No Forwarding Address," and returned the mail piece to the sender. In this scenario, the piece of mail returned to the sender is marked "Undeliverable as Addressed," and is, in fact, undeliverable as addressed.

In other cases, however, a mail piece may be marked "Undeliverable as Addressed" when in fact the address is correct. Sometimes this happens because of a mistake on the part of a Postal Service employee. Other times, the addressee may have provided a change of address shortly after having moved, almost ninety days earlier, and then a mailing company, without pre-screening its mailing addresses before addressing its mail, uses an address for which the forwarding instructions expire before the mail can be delivered. In that case, the Postal Service will mark the mail, correctly, as "Undeliverable as Addressed," and then the company's internal address database should be updated with current address information from, for example, the U.S. Postal Service National Change of Address (NCOA) database.

During 1997 the United States Internal Revenue Service (IRS) mailed 99,919 refund checks to taxpayers that were returned by the USPS as undeliverable. The taxpayers may have written down their incorrect names and addresses, or the taxpayers may have moved without giving the IRS their new address. Other governmental agencies who make mass mailings also have large numbers of mail pieces returned as undeliverable. Mass mailers in the private sector, i.e. banks, brokerage firms, catalog companies, etc. also experience the above problem. Furthermore, mailers who want to send recipients valuable goods and/or legal papers, etc. want their mail to delivered to the correct person or entity.

SUMMARY OF THE INVENTION

This invention overcomes the disadvantages of the prior art by providing a method that enables the post to reduce the number of undeliverable letters, flats, post cards and packages (mail) addresses to a recipient. The invention accomplishes the foregoing by: assigning a unique code to each recipient that specifically identifies the recipient, i.e., social security number, tax identification number, etc.; relating recipients code with recipients name and delivery address; relating recipients address changes with recipients name and unique code; permitting individuals or entities to add recipients unique code to the recipient mailing address; reading information on mail to capture the unique code when present, determining recipient's delivery address from recipients code and recipient's name.

An advantage of this invention is that each mail recipient will have a unique code that will always relate the recipients name and any address change with the unique code. Thus, the number of address change errors will be reduced and a larger percentage of mail will be delivered to the correct address.

In an alternate embodiment of this invention recipients unique code is encrypted.

In another alternate embodiment of this invention, the invention may be used in a corporate mail room.

DETAILED DESCRIPTION OF THE PREFERRED EMBODIMENT

Figure 1:
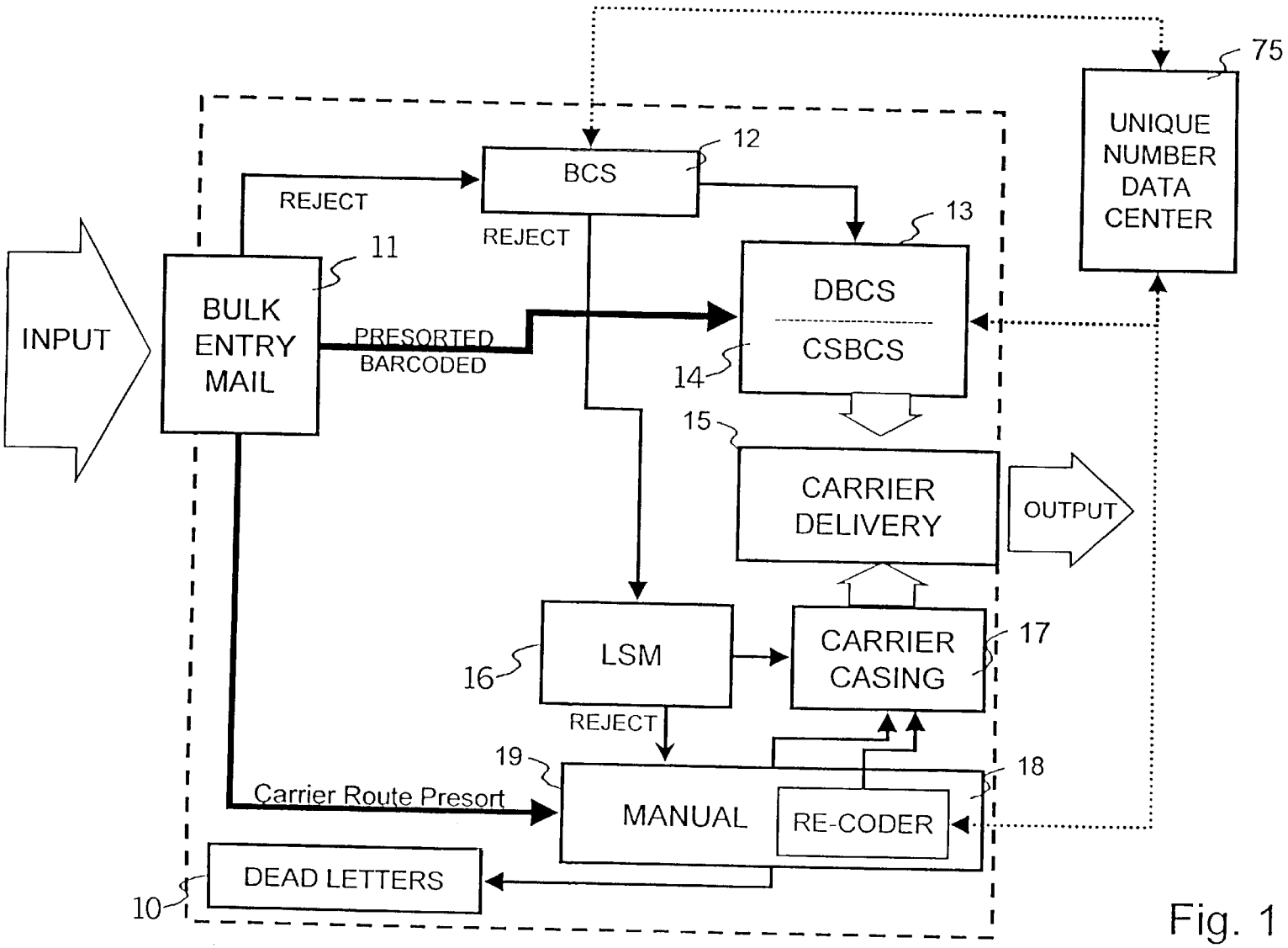
FIG. 1 is a drawing showing how this invention may be used in the processing of bulk entry mail.

Referring now to the drawings in detail and more particularly to FIG. 1, the reference character 11 represents the entry of bulk entry mail to the post. The post receives and process bulk entry mail and collection mail. Collection mail will be described in the description of FIG. 2. Approximately 60 percent of the mail currently received by the United States Postal Service is bulk entry mail. Bulk entry mail is mail received by the post that is trayed, presorted, metered, bearing a permit or pre-cancelled stamp. Bulk entry mail that has been bar coded but not sorted correctly by the mailer will be scanned and sorted by bar code sorter/code printer 12. Mail that is able to be scanned and sorted by sorter 12 is sent to a delivery bar code sorter/code printer 13 or a carrier sequence bar code sorter 14. Sorters 13 sorts mail that is going to be delivered to other postal facilities. Sorter 14 sorts mail in the order that the mail is going to be delivered by postal carrier 15.

Mail that can not be scanned and sorted by sorter 12 is sent to letter sort machine 16. Letter sort machine 16 is a manually operated machine in which the operator enters a zip code for the mail. Machine 16 is a mechanical sorter that sorts the mail in accordance with the zip code entered by the operator of machine 16. Mail that can be sorted by letter sort machine 16 is sent to carrier casing 17. Carrier casing 17 is the process in which the postal carrier sorts the mail in the order that the mail is going to be delivered by postal carrier 15. Mail that can not be sorted by letter sort machine 16 is sent to manual process 19. Manual process 19 attempts to classify the previously rejected mail piece to: redirect the mail piece; declare the mail piece dead; or manually re-code the mail piece for redelivery. Then the mail piece that has not been processed in manual process 19 is re-coded in process 18. In re-coder process 18 an operator may look up the unique code in unique code data center 75 and produce a label to be placed on the mail piece. Mail that can not be recorded in process 18 is sent to dead letters 10. Bulk entry mail that has been presorted in accordance with the postal carrier route is sent in trays to manual process 19. Then the mail would go to carrier casing 17 where the mail is sorted in the order that the mail is going to be delivered by postal carrier 15.

Figure 4:
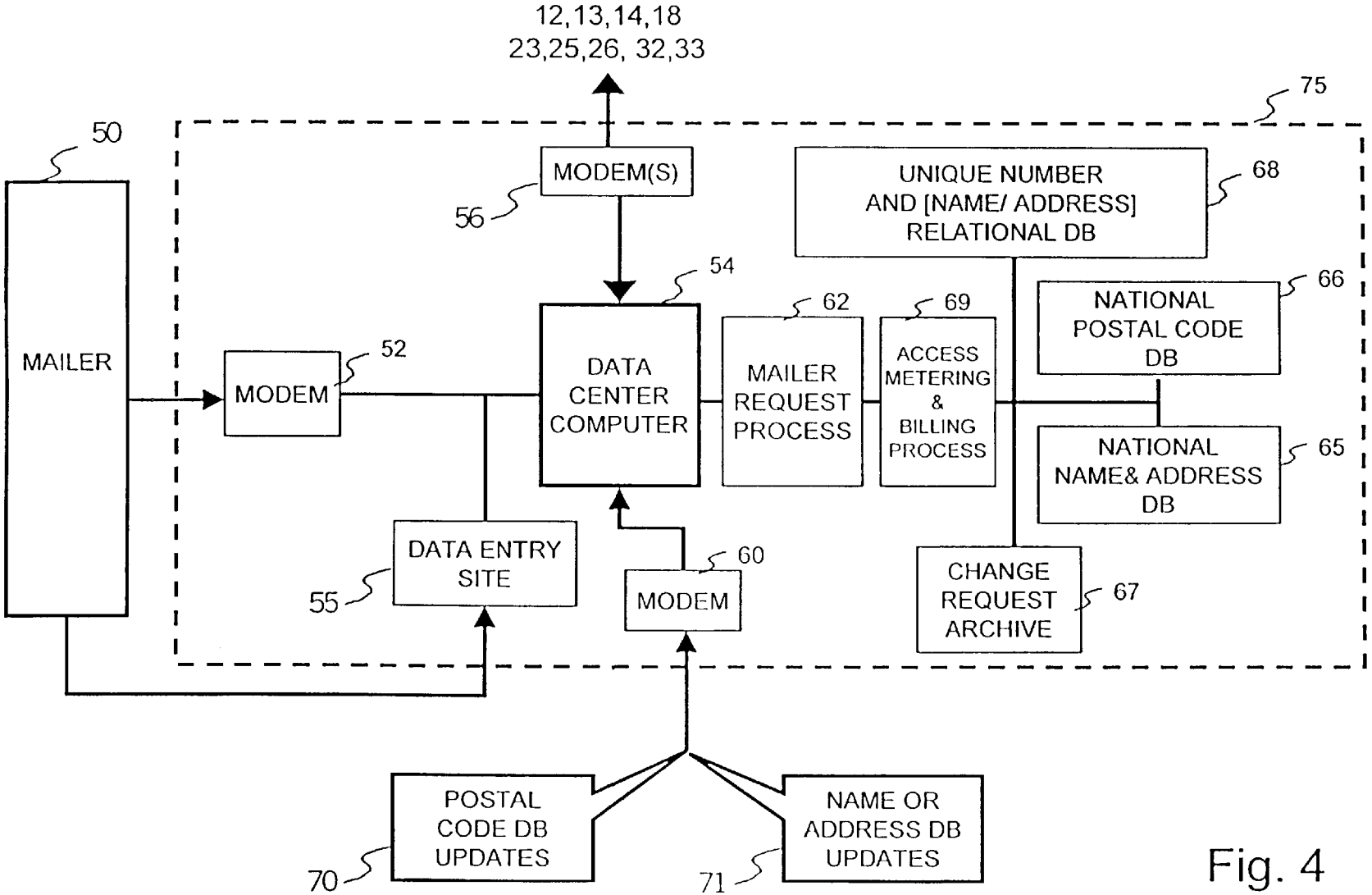
FIG. 4 is a drawing showing how one may change the address to which their mail having a unique code will be delivered.

Mail that has been scanned by bar code sorter 12 and mail that has been scanned by sorters 13 and 14 will be checked by unique code data center 75, if scanners 12, 13 or 14 detect a unique code in the recipient address field of the mail, i.e., 1020 49 337 491XJDX092299 or scan a unique code in the bar code affixed to the mail by the mailer. Unique code data center 75 contains a name/address relational data base 68 (FIG. 4). Data base 68 will use the unique code number to determine the actual destination that the recipient wants the mail delivered to. The foregoing may be accomplished by looking up the unique code in data base 68 and determining the address that the owner of the unique code is currently having their mail delivered. Data base 68 supplies information to sorters 12, 13 and 14 and re-coder 18 via computer 54 so that sorters 12, 13 and 14 and re-coder 18 will place a bar code on the mail that indicates the zip code that the owner of the unique code is currently having their mail delivered. Sorters 12, 13 and 14 and re-coder 18 will also print the street, city and state that the owner of the unique code is currently having their mail delivered in human readable form.

Figure 2:
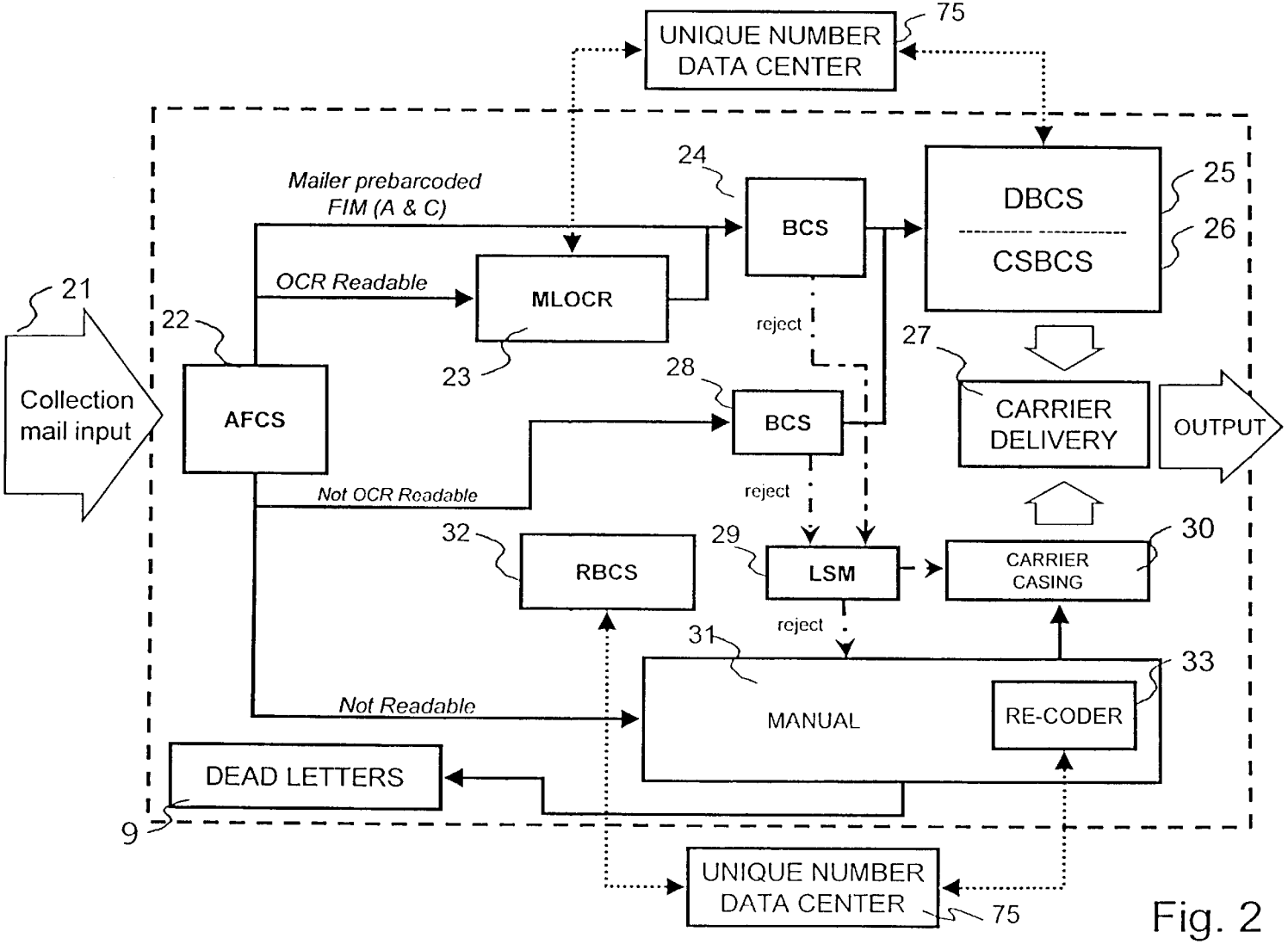
FIG. 2 is a drawing showing how this invention may be used in the processing of collection mail.

FIG. 2 is a drawing showing how this invention may be used by the post in the processing of collection mail 21. Approximately 40 percent of the mail currently received by the United States Postal Service is collection mail. Collection mail is metered, stamped or business reply permit mail that is placed in mail boxes or delivered to the United States Postal Service unsorted. Collection mail is sent to advanced facer canceller 22. Facer canceller 22 first faces the mail. Then facer canceller 22 electronically identifies and separates prebarcoded mail, handwritten addresses and machine-imprinted address pieces for faster processing through automation. Mail that canceller 22 determines is optical character readable is sent to multi-line optical character reader/code printer 23. Reader 23 reads the entire address on the mail, sprays a bar code on the mail, and then sorts the mail. Mail that is able to be scanned and sorted by reader 23 is sent to bar code sorter/code printer 24. Mail that the mailer has prebarcoded and contains a facing identification mark is sent to bar code sorter/code printer 24.

Mail that is able to be scanned and sorted by sorter 24 is sent to a delivery bar code sorter/code printer 25 or a carrier sequence bar code sorter/code printer 26. Sorters 25 and 26 sort the mail in the order that the mail is going to be delivered by postal carrier 27. Mail that canceller 22 determines is not optical character readable is sent to bar code sorter/code printer 28. Mail that canceller 22 obtains electronic images from and mail that reader 23 obtains electronic images from transfers the electronic images to remote bar code system 32. Bar code system 32 matches the look up zip code for the mail pieces from canceller 22 and merges them. System 32 electronically transmits the bar code information to sorter 28 where the bar code information is sprayed on the mail pieces. Mail that is able to be scanned and sorted by sorters 24 and 28 is sent to a delivery bar code sorter 25. Sorters 25 and 26 sort the mail in the order that the mail is going to be delivered by postal carrier 27.

Mail that can not be scanned and sorted by sorters 24 and 28 is sent to letter sort machine 29. Mail that can be sorted by letter sort machine 29 is sent to carrier casing 30. Carrier casing 30 is the process in which the postal carrier sorts the mail in the order that the mail is going to be delivered by postal carrier 27. Mail that can not be sorted by letter sort machine 29 is sent to manual process 31. Manual process 31 attempts to classify the previously rejected mail piece to: redirect the mail piece; declare the mail piece dead; or manually re-code the mail piece for delivery. Then the mail pieces that has not been processed in manual process 31 is re-coded in process 33. In re-coder process 33 an operator may look up the unique code in unique code data center 75 and produce a label to be placed on the mail piece. Mail that can not be recoded in process 33 is sent to dead letters 9. Then the mail would go to carrier casing 30 where the mail is sorted in the order that the mail is going to be delivered by postal carrier 27.

Mail that can not be faced and cancelled by canceller 22 is sent to manual process 31. Manual process 31 attempts to classify the previously rejected mail piece to: redirect the mail piece; declare the mail piece dead; or manually re-code the mail piece for redelivery. Then the mail that manual process 31 is able to classify is sent to carrier casing 30 before it is delivered by carrier 27. Mail that can not be classified by process 31 is sent to recorder 33. Recorder 33 will look up the unique code in unique code data center 75.

Mail that has been read by reader 23 and mail that has been coded by system 32 or by re-coder 33 will be checked in unique code data center 75, if a unique code 40 appears in the recipient address field of the mail or in the bar code affixed to the mail, i.e., 1020 49 337 491XJDX092299 or scan a unique code in the bar code affixed to the mail by the mailer. Unique code data center 75 contains a unique code name/address relational data base 68 (FIG. 4). Data base 68 will use the unique code number to determine the actual destination that the recipient wants the mail delivered to. The foregoing may be accomplished by looking up the unique code in data base 68 and determining the address that the owner of the unique code 40 is currently having their mail delivered. Data base 68 supplies information to reader 23, sorters 24, 25, 26 and 28 and re-coder 33 so that sorters 23, 25, 26 and 28 and re-coder 33 will place a bar code on the mail that indicates the zip code that the owner of the unique code is currently having their mail delivered. Sorters 24, 25, 26 and 28 and re-coder 33 will also print the street, city and state that the owner of the unique code currently wants their mail delivered in human readable form.

Figure 3A:
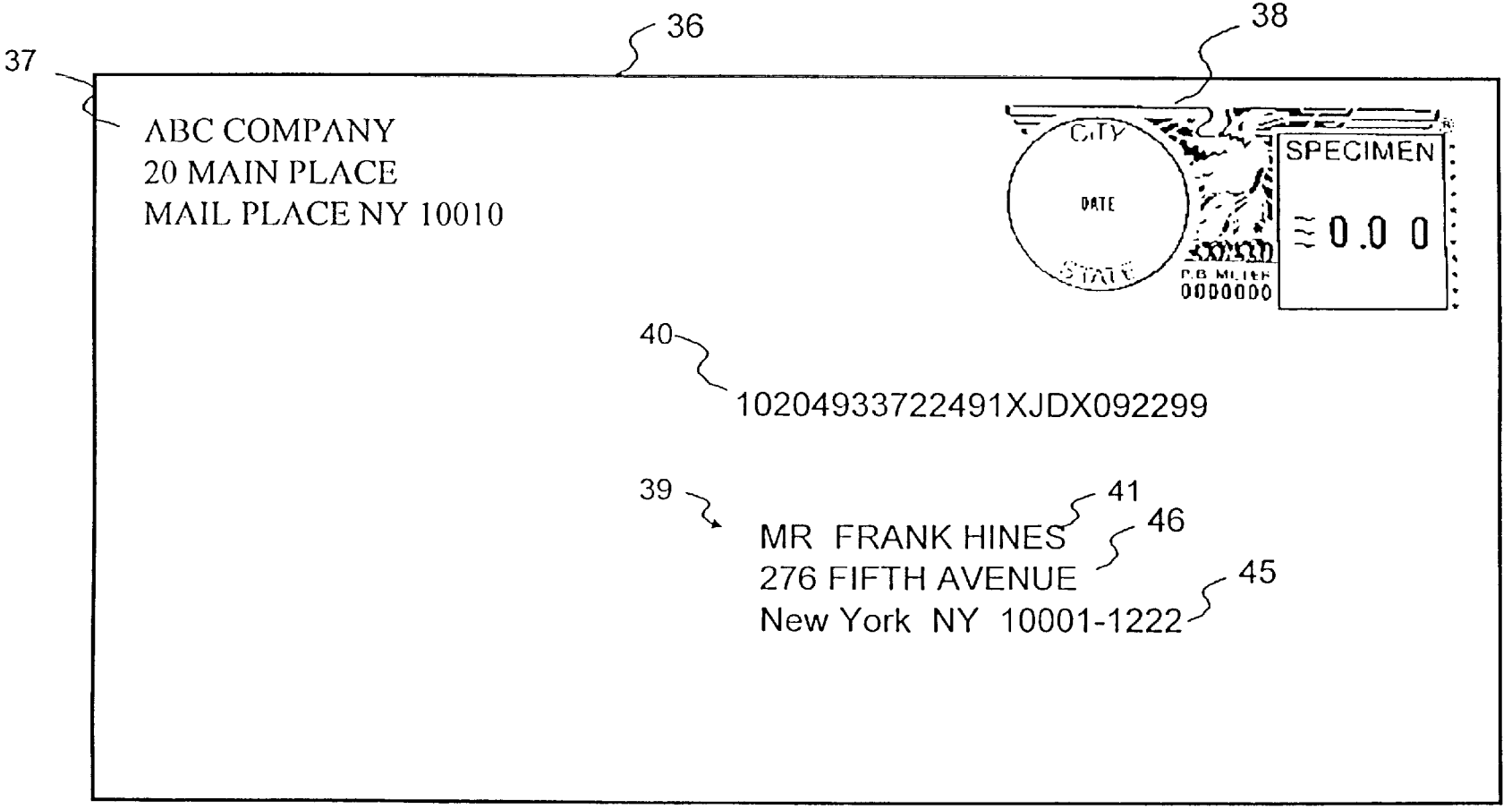
FIG. 3A is a drawing of a mail piece having a unique code in the address field.

FIG. 3A is a drawing of a mail piece having a unique code 40 as part of its address. Unique code 40 may be printed in alphanumeric characters, or as a one or two dimensional bar code, etc. Unique code 40 may be an encrypted version of recipients social security number or tax identification number, etc. The encryption may be based upon any recognized code such as the Data Encryption Standard (DES) or the Rivest, Shamir and Adleman Cipher (RSA). Upon the appropriate information being supplied to an encryptor (not shown) from computer 54 (FIG. 4) would generate an encrypted code from its inputs and send the code back to computer 54. The appropriate information may include recipients social security number or tax identification number, the date, time of the day the encryption was made to nanoseconds, the current address of the recipient, the number of unique codes requested in the last thirty minutes, etc.

Mail piece 36 has a sender address field 37 and material 38 that indicates the payment of the postage for mail piece 36. Material 38 may be a postal indicia, postal permit or one or more stamps. The recipient address field 39 will only have to include the unique code 40, i.e., 1020 49 337 491XJDX092299 and the name of the person or entity 41 to whom mail piece 36 is sent. The street address 46 and the city, state and zip code 45 may also be included on mail piece 36.

Figure 3B:
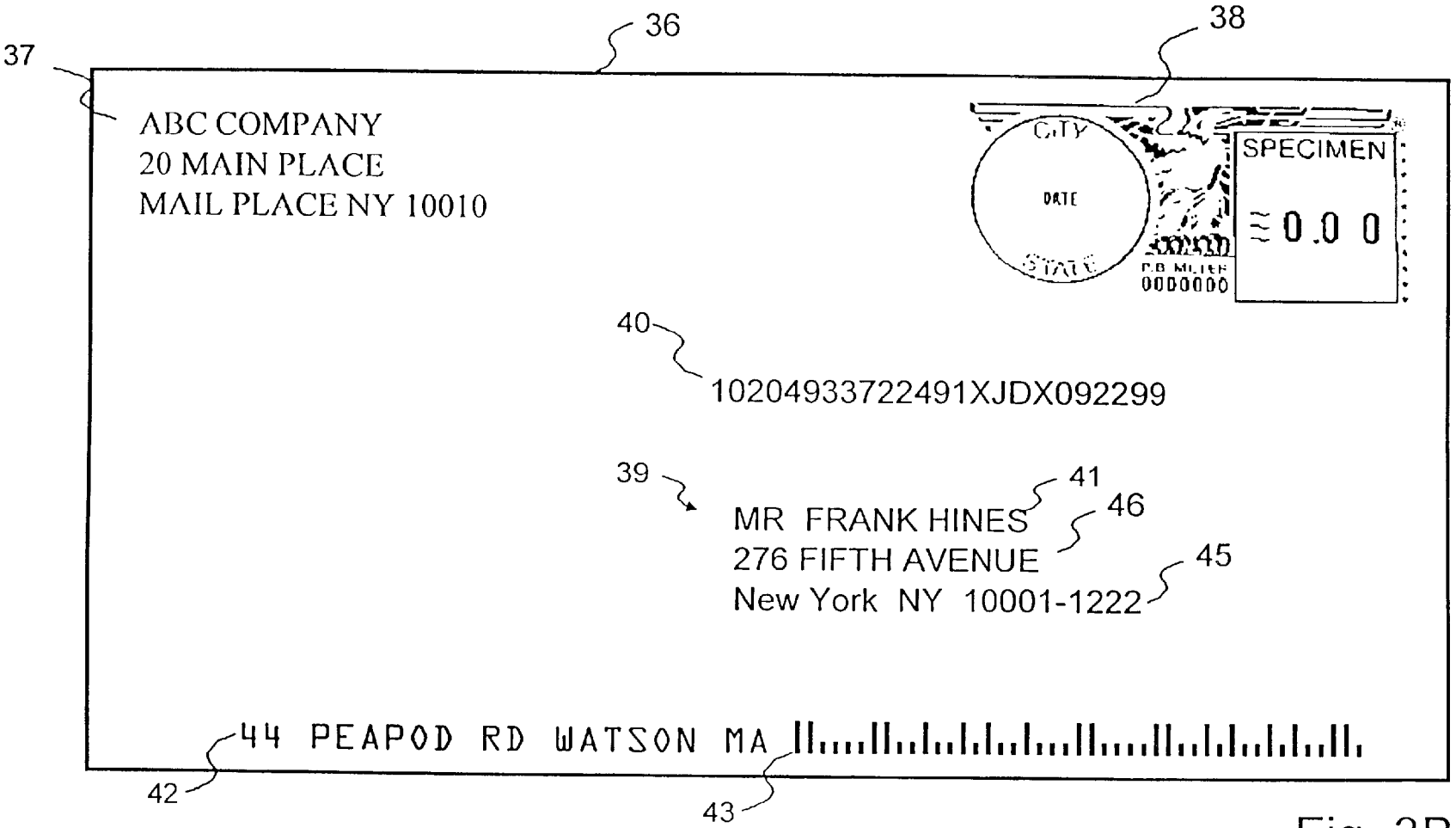
FIG. 3B is a drawing of a mail piece having a unique code in the address field which the post has indicated the delivery address of the moved recipient.

FIG. 3B is a drawing of a mail piece having a unique code in the address field which the post has indicated the delivery address of the moved recipient. Mail piece 36 has a sender address field 37 and material 38 that indicates the payment of the postage for mail piece 36. Material 38 may be a postal indicia, postal permit or one or more stamps. The recipient address field 39 will include the unique code 40, i.e., 1020 49 337 491XJDX092299 and the name of the person or entity 41 to whom mail piece 36 is sent. The street address 46 and the city, state and zip code 45 may also be included on mail piece 36. The post will print the delivery address 42 that the owner of the unique code currently wants mail piece 36 delivery to. The post will also print a postnet bar code 43 on the face of mail piece 36. Bar code 43 represents the delivery address 42 in a coded form.

FIG. 4 is a drawing showing how a mailer may obtain a recipient's unique code and how a recipient may change the address to which their mail is currently being delivered. Mailers 50 may communicate their intentions regarding the determination of a unique code for particular parties or entities via a personal computer.

If, a mailer communicated with the post via a personal computer (not shown), the mailer may communicate with post office modem 52, which is coupled to data center computer 54. Computer 54 and the mailer's personal computer may have various protocols that are known in the art that must be satisfied before the mailers computer can obtain unique code and address information from computer 54. After the protocols have been satisfied computer 54 may obtain enough information from the mailers computer and unique code name/address relational data base 68 to determine the recipients current address from recipients unique code.

A mailer may also communicate by physically going to a clerk's desk 55 at data entry site 55. The mailer would then give the postal clerk a name and a unique code and the postal clerk would ask computer 54 to check unique code name/address relational data base 68 and determine recipients currently listed delivery address. The mailer may also mail name and unique code information to site 55 and request the current address for the name and unique code given. A recipient may also go to site 55 and give the clerk the change of address card shown in FIG. 5 to change their delivery address.

National name and address data base 65 is coupled to national postal code data base 66 and mailer request process 62. Data base 65 includes the names and addresses of people and entities residing in the United States. National postal code data base 66 includes every valid postal deliverable address in the United States. Change request data base 67 is coupled to unique code name/address relational data base 68. Data base 65 is used as a reference for data base 68 and changes to data base 68 are received from change request data base 67. Postal code updates computer 70 will transmit new zip codes to national code data base 68 via modem 60, computer 54, process 62 and process 69. Name or address updates computer 71 will transmit new name or recipient address changes to data base 65 via modem 60, computer 54, process 62 and process 69. Data bases 65, 66 and 68 are periodically updated.

Computer 54 will obtain mail forwarding information for mail piece 36 by receiving the information from data base 68 when a proper mailer request is received from mailer user request process 62 and process 69 metered the above request. Data base 68 will indicate the current listed address for each name and unique code. Computer 54 will transmit the current address that the recipient has for their unique code in data base 68 to modem 56. The current address will be sent in the form of a postnet bar code as well as in human readable text. Modem 56 will transmit the address to sorters 12, 13 and 14 and re-coder 18 (FIG. 1) and sorters 24, 25, 26 and 28 and re-coder 33 (FIG. 2).

Mailer request process 62 is coupled to computer 54. Process 62 determines whether or not the mailer will receive the delivery address of the recipient when the name of the recipient and unique code are given. Process 62 also determines the delivery address for the name and unique number read by the post office.

Figure 5:
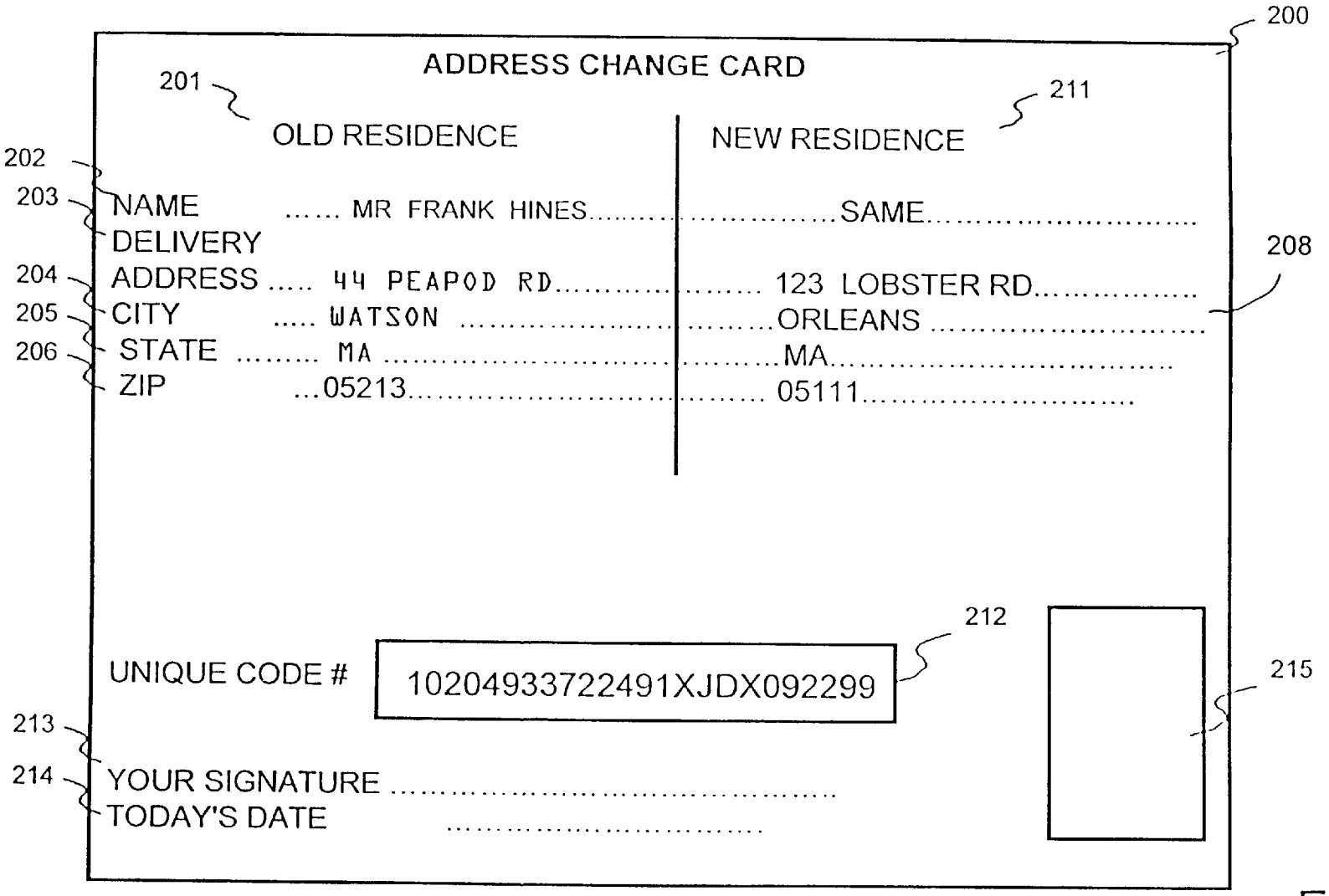
FIG. 5 is a change of address registration card 200.

FIG. 5 is a change of address registration card 200. Card 200 may be used for registering a unique code or for changing the delivery address for the unique code. Card 200 indicates: the primary residence 201 of the person or entity who is registering for a unique code in space 202; their street delivery address in space 203; their delivery city in space 204; their delivery state in space 205; and their delivery zip code in space 206. The assigned unique code 40 is shown in space 212. Unique code 40 may be printed in alphanumeric characters, or as a one or two dimensional bar code, etc. Unique code 40 may be an encrypted version of recipients social security number or tax identification number, etc. The date in which the recipient having the unique code wants mail to be delivered their new delivery address or new residence 211 is shown in space 208. The signature of the person who is obtaining a unique code or changing their delivery address will be placed in space 213. The date the signature was signed in space 213 is indicated in space 214. A biometrics 215 of the person whose signature appears in space 213 may also be placed on card 200. Biometrics 215 may be: a picture of the person signing in space 213; the person's fingerprint; etc.

The recipient having the unique code may modify or change any information contained in card 200 by going to data center 75 (FIG. 4) and showing card 200 to the clerk. Biometrics 215 may be used by data center 75 to further authenticate the person modifying or changing any information contained in card 200.

Figure 6:
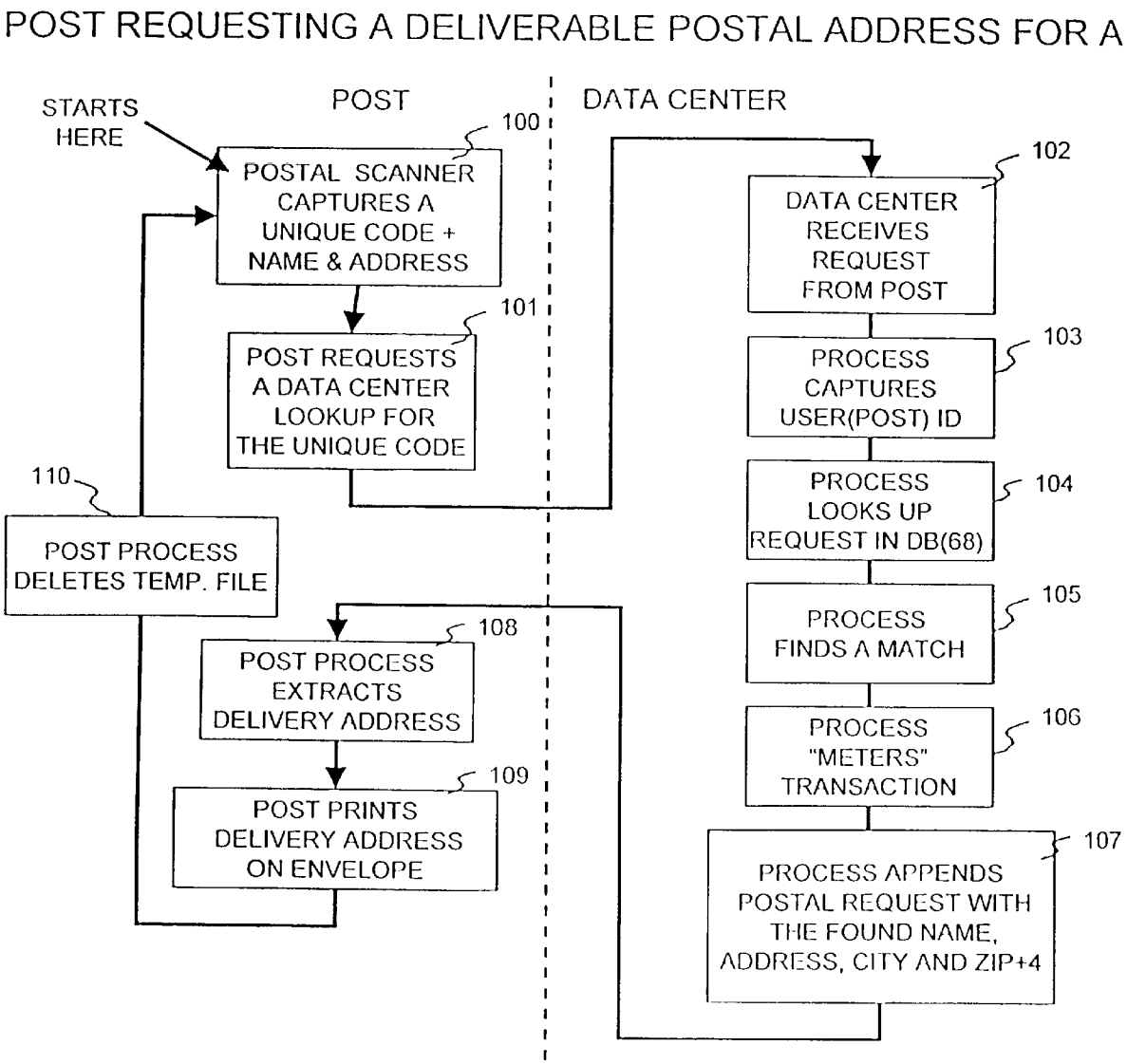
FIG. 6 is a drawing of a flow chart showing a request by the post for a postal address for a unique code.

FIG. 6 is a drawing of a flow chart showing a request by the post for the current postal delivery address for a name and a unique code. The program begins in block 100 where a postal scanner (FIG. 1, FIG. 2) captures the name 41, unique code 40, and delivery address from a mail piece 36 (FIG. 3A, FIG. 3B). Then the program goes to block 101 where the post requests data center 75 to lookup the current delivery address for the name and unique code number scanned. Now the program goes to block 102 where data center 75 receives a lookup request from the post. Next in block 103 data center 75 captures the identity of the post office that scanned the mail piece.

In block 104 the process searches the unique codes in data base 68 to find the current postal delivery address for the name and unique code captured. In block 105 the process determines whether or not the delivery address matches the name and unique code. Then the program goes to block 106 where access metering and billing process 69 meters the above transaction so that the post or mailer may be charged for the services provided. At this point in block 107 the process appends a new delivery address that matches the name and unique code captured, if the delivery address differs from the delivery address captured. The new delivery address is supplied in a postnet bar code format as well as in human readable text. Next in block 108 the post extracts the looked up address. Then in block 109 the post's scanners (FIG. 1 and FIG. 2) prints the looked up address on a mail piece in a postnet bar code format as well as in human readable text. At this point the program goes to block 110 where the post deletes the temporary file. Then the program goes back to the input of block 100.

Figure 7:
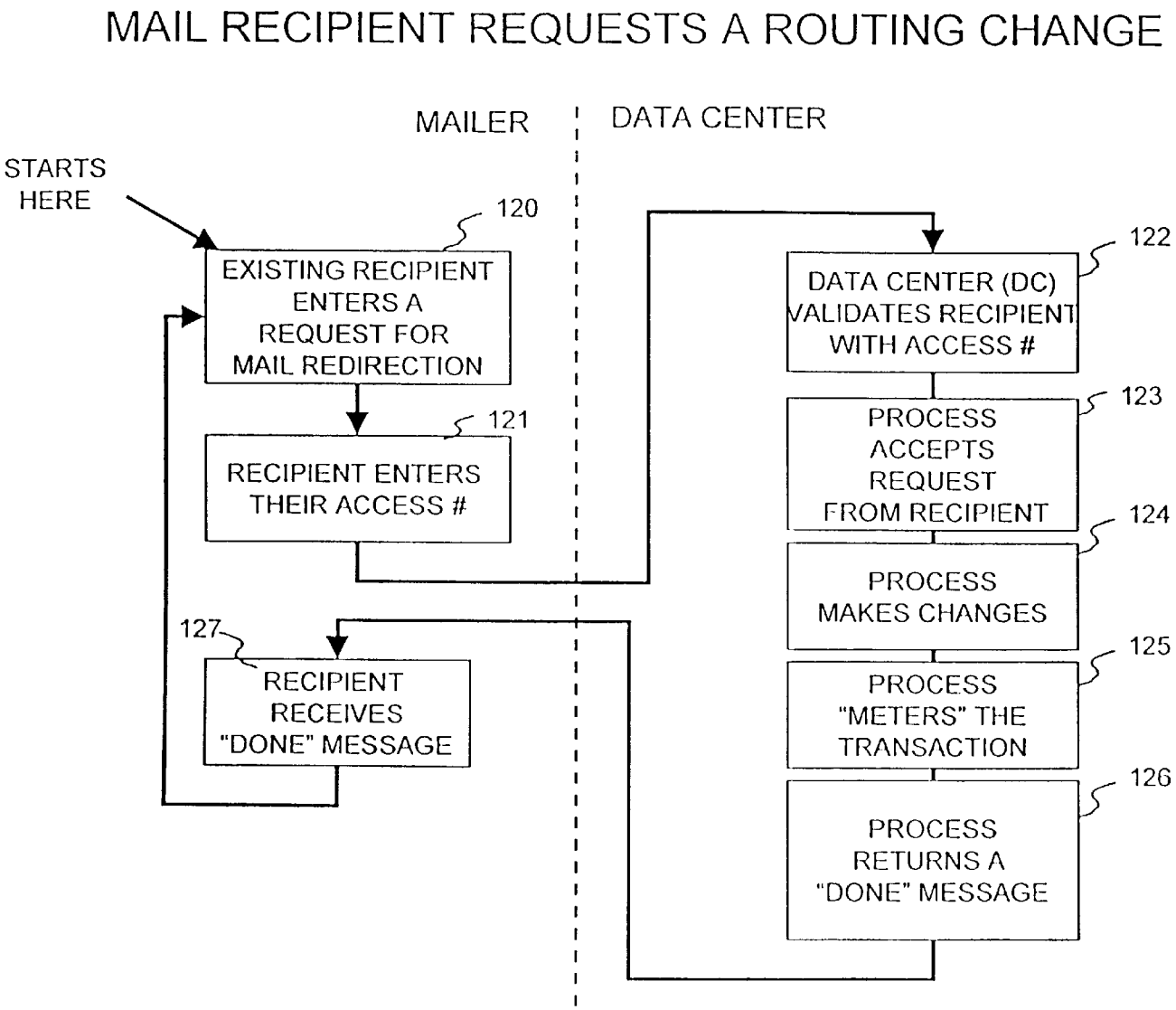
FIG. 7 is a drawing of a flow chart showing a request by a mail recipient requesting a routing change for their unique code.

FIG. 7 is a drawing of a flow chart showing a request by a mail recipient requesting a routing change for their unique code. The program begins in block 120 where a mail recipient enters a request to have the delivery address for their unique code number changed to a different delivery address. Then the program goes to block 121 where the recipient enters their unique code. Now the program goes to block 122 where data center computer 54 validates the recipient by determining whether or not the recipient has the correct name and unique code. Next in block 123 computer 54 accepts the request from the recipient. In block 124 computer 54 makes the address change requested by the recipient. The requested changes are stored in data bases 67 and 68. In block 125 access metering and billing process 69 meters the above transaction so that the post, mailer, or recipient may be changed for the services provided. Then the program goes to block 126, where process 69 indicates the process was completed. Now the program goes to block 127 where the mailer receives a message that the requested address change has been completed. At this point the program goes back to the input of block 120.

Figure 8:
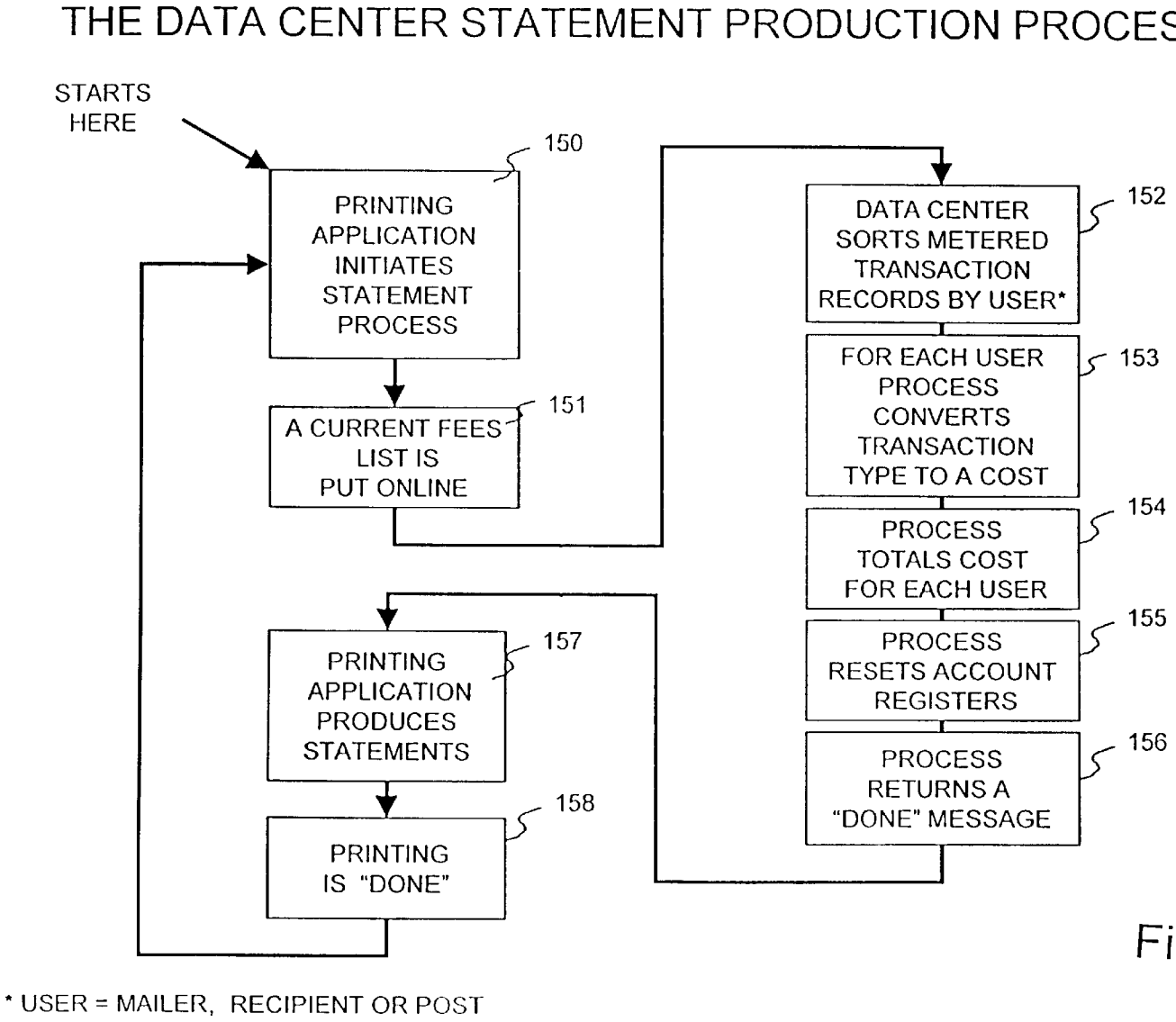
FIG. 8 is a drawing of a flow chart showing the generation of a statement by access metering and billing process 69.

FIG 8 is a drawing of a flow chart showing the generation of a statement by the access metering and billing process 69 of FIG. 2. The program begins in block 150 where a statement initiation process is begun. Then the program goes to block 151 where the current fees for the requested services are transmitted. Now the program goes to block 152 where data center computer 54 sorts the transactions metered by process 69 and records the transactions by specific mailers, recipients and the post. Next in block 153 computer 54 converts each transaction type to a cost. In block 154 computer 54 totals the cost for each specified mailer, recipient and the post. The program goes to block 155 to reset the account registers. In block 156 the program produces a done message upon completion of the task. Next in block 157 a printer (not shown) at data center 75 produces statements for the provided services. Then the program goes to block 158 to indicate that the printed statements are completed. At this point the program goes back to the input of block 150.

Figure 9:
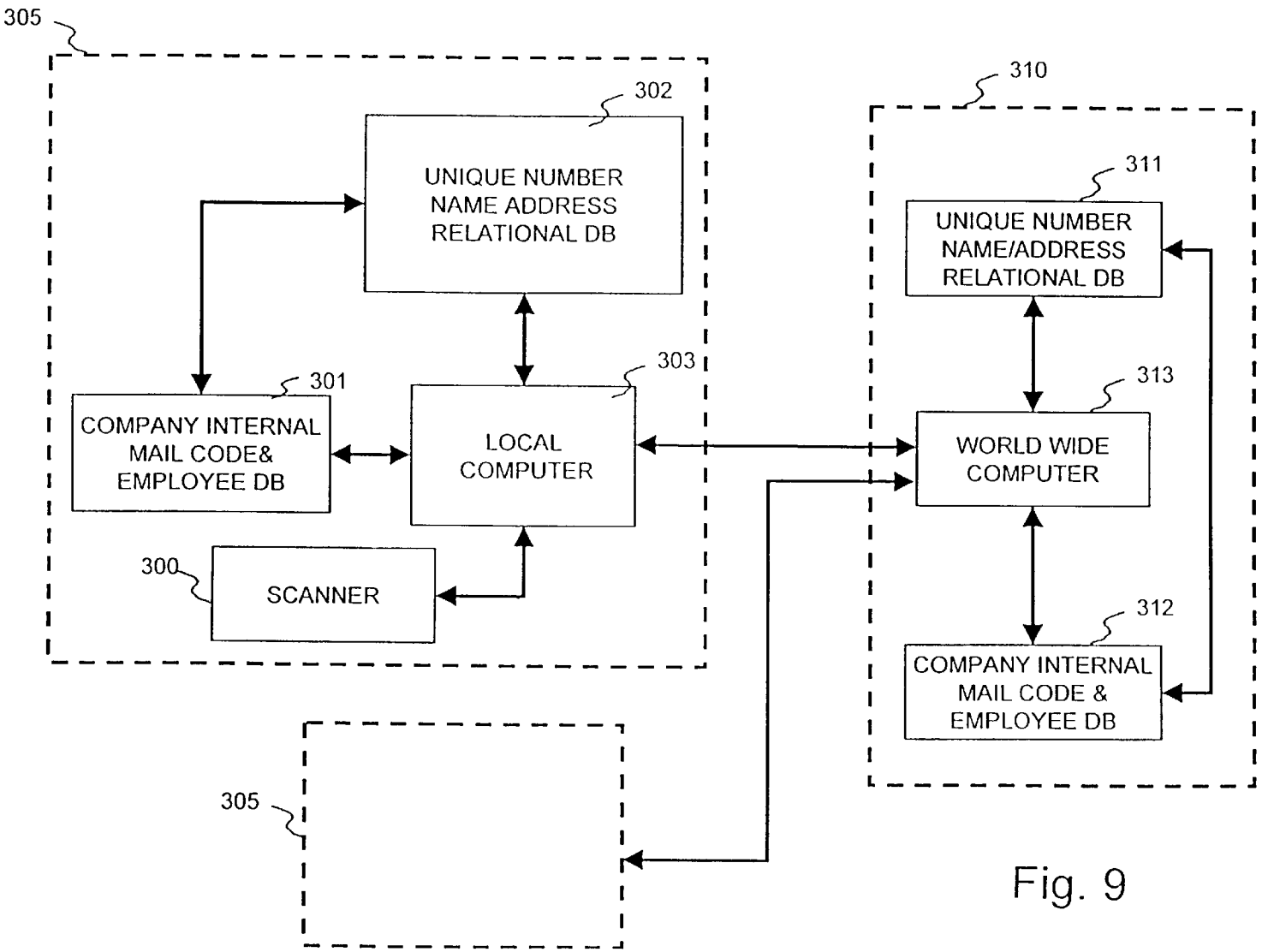
FIG. 9 is a drawing of an alternate embodiment of this invention showing how the invention may be used in a corporate mail department.

FIG. 9 is a drawing of an alternate embodiment of this invention showing how the invention may be used in a corporate mail department. Many corporations and governmental agencies, including the military have large numbers of employees, soldiers, sailors or airmen that are employed at many different locations. The corporations and governmental agencies have created their own internal postal addressing system, i.e. APO (postal boxes for the military), etc. Some internal addressing systems include specific building designations and internal building locations, i.e. TC 3 26-22 (Technology Center, building 3, location 26-22). Many of the employees move from one location to another and the mail room and telephone directory often does not have their new mail internal and/or external mail delivery location.

Each company may have a plurality of mail rooms 305. A mail room 305 will include a scanner 300, data bases 301 and 302 and a computer 303. Scanner 300 is coupled to computer 303. Company internal mail code data base 301 is coupled to unique number name/address relational data base 302 and computer 303. Data base 302 is also coupled to computer 303. Data base 301 contains the companies internal mail codes and the employees who have those mail codes. Data base 302 links the internal mail codes with the employees name to a unique number. Input means (not shown) to computer 303 may be used to update data bases 301 and 302.

Each company will have a mail room 310 that has world wide responsibilities. Mail room 310 includes: data bases 311 and 312 and a computer 313. Company internal mail code data base 311 is coupled to unique number name/address relational data base 312 and computer 313. Data base 302 is also coupled to computer 313. Data base 311 contains the companies internal mail codes and the employees who have those mail codes. Data base 312 links the internal mail codes and the employees name and unique number. Input means (not shown) to computer 313 may be used to update data bases 311 and 312. Computer 313 is coupled to each computer 303 and will supply world wide updates to data bases 301 and 302 via computer 303.

Mail delivered to the company will be read by scanner 300. Scanner 300 will read the name and unique code 40 affixed to the mail. The company may use the same manner as previously discussed to obtain code 40 or use a different method, i.e. the employees' employment number may be used. The company may use this method to deliver its internal mail even though the post does not elect to use it. Scanner 300 will read the name and unique code 40 affixed to the mail. Scanner 301 will transmit the name and unique code to computer 303. Computer 303 will match the name and unique code in name/address relational data base 302. Computer 303 will cause scanner 300 to print the internal delivery address that represents the internal location of the owner of the unique code that the mail was addressed to.

The above specification describes a new and improved system and method for enabling the post to deliver mail addressed to a name and a recipient unique code to be delivered directly to the recipient. It is realized that the above description may indicate to those skilled in the art additional ways in which the principles of this invention may be used without departing from the spirit. It is, therefore, intended that this invention be limited only by the scope of the appended claims.

What is claimed is:

1. A method for delivering mail that is addressed to a named recipient, said method comprises the steps of:

receiving recipient's name and recipient's current delivery address;

assigning a unique code for individual recipients;

relating in a database recipient's unique code with recipient's name and current delivery address;

delivering information to recipient's that represents their assigned unique codes;

placing by the sender of mail information that represents recipient's name and unique code on mail;

reading information on mail to capture recipients name and unique code, when present;

changing recipient's current delivery address in the data base in accordance with recipient's instructions;

determining recipient's current delivery address from recipients name and unique code;

printing by a mail carrier on mail recipient's current delivery address if the current delivery address on the mail differs from the recipient's delivery address currently in the data base; and delivering mail to recipient's current delivery address.

2. The method claimed in claim 1, wherein in the changing step: recipient specifies the time when mail will be delivered to the changed delivery address.

3. The method claimed in claim 1, further including the step of:

billing for the number of times recipient's changed their desired delivery address.

4. The method claimed in claim 1, wherein recipients unique code is represented in alphanumeric characters.

5. The method claimed in claim 1, further including in the changing step, the steps of:

assigning a biometrics to recipients;

delivering a biometrics to recipients;

receiving recipient's biometrics and recipient's intention to change their delivery address;

changing recipients delivery address upon conformation of recipients biometrics.

6. The method claimed in claim 1, further including the steps of:

receiving a request from mailers for recipients current delivery address;

receiving from mailers recipients name and unique code;

delivering recipients current delivery address to mailers.

7. The method claimed in claim 1, wherein recipient's unique code is encrypted.

8. The method claimed in claim 1, further including the step of:

metering the number of times recipient's desired delivery address was determined.

9. The method claimed in claim 8, further including the step of:

billing for the number of times mailers requested recipient's current delivery address.

10. The method claimed in claim 1, wherein recipient's current delivery address is placed on mail in coded form.

11. The method claimed in claim 10, wherein recipient's current delivery address is placed on mail in human-readable form.

12. The method claimed in claim 10, wherein recipient's desired delivery address is placed on mail in coded form and human-readable form.

* * * * *